United States Patent [19]

Wiley et al.

[11] 4,303,189

[45] Dec. 1, 1981

[54] SYSTEM AND METHOD FOR ALIGNING FABRIC

[75] Inventors: Thomas W. Wiley, Asheville; William R. Joyce, Gerton, both of N.C.

[73] Assignee: Tex-Fab, Inc., Gerton, N.C.

[21] Appl. No.: 107,533

[22] Filed: Dec. 27, 1979

[51] Int. Cl.[3] ..... B65H 25/10; B65H 25/26

[52] U.S. Cl. ..... 226/15; 26/51.5; 26/77; 226/17; 226/20; 226/21; 250/548; 250/561; 250/571

[58] Field of Search ..... 226/3, 15, 17, 18, 19, 226/20, 21, 22; 242/57.1; 26/51.5, 77; 250/548, 559, 560, 561, 571

[56] References Cited

U.S. PATENT DOCUMENTS

| | | | |
|---|---|---|---|
| 2,208,420 | 7/1940 | Gulliksen | 226/20 |
| 2,312,182 | 2/1943 | Meyer | 226/20 |
| 2,332,104 | 10/1943 | Meyer | 226/20 |
| 2,966,593 | 12/1960 | Leimer | 26/51.5 X |
| 3,077,656 | 2/1963 | Mahlo | 26/51.5 |
| 3,406,887 | 10/1968 | Laycak | 226/21 |
| 3,701,464 | 10/1972 | Crum | 226/3 |
| 3,752,377 | 8/1973 | Knapp | 226/3 X |
| 4,021,031 | 5/1977 | Meihofer | 226/20 |
| 4,135,664 | 1/1979 | Resh | 226/3 X |

*Primary Examiner*—Stanley N. Gilreath
*Attorney, Agent, or Firm*—Luedeka & Fitch

[57] ABSTRACT

A system for aligning a moving run of fabric which has longitudinal and transverse threads along a path determined by a selected one of the longitudinal threads. The system includes optics for projecting an image of the longitudinal threads while suppressing the image of transverse threads, means for determining the direction of any deviation and the amount of deviation from the selected thread position, and guidance means for returning the run to a position in which the selected thread is in its desired position. An improved guidance means which effects transverse movement of the fabric run without introducing wrinkles or bias into the run is also disclosed.

9 Claims, 13 Drawing Figures

BALANCED
CELL 43 COVERED

UNBALANCED LEFT
CELL 43 COVERED

BALANCED
CELL 43 UNCOVERED

UNBALANCED RIGHT
CELL 43 COVERED

BALANCED
CELL 43 COVERED

SYSTEM AND METHOD FOR ALIGNING FABRIC

The present invention relates generally to a system for control of the longitudinal movement of a run of fabric or the like and, more particularly, relates to a system and method for aligning a strip of fabric or the like for movement relative to a selected longitudinal thread in the fabric.

Various systems and methods have been employed to align fabric and control its direction of movement incident to various fabric converting operations, e.g. sewing, hem making and the like. Substantially all of these prior devices have been operable through the sensing of one edge of the fabric which is maintained in a given position relative to a fixed point on the processing apparatus. This has been accomplished by various means the most common being controlled by the action of a pair of photocells which sense the position of the edge of the fabric. This is accomplished by projecting a light on the photocells, the photocells being arranged in side by side arrangement with the desired position of the edge of the fabric being between the two cells. Thus, when the fabric is in the proper position it covers one cell and leaves the other uncovered. If the normally covered cell is not covered completely, the voltage level rises and the steering mechanism moves the fabric in a direction which will cover the cell. On the other hand, if the normally uncovered cell is covered, the voltage level will drop and the mechanism will steer the fabric in a direction which will uncover the cell. Such devices are relatively simple in operation but have the disadvantage that the marginal edges of fabric are usually uneven so that when the fabric is aligned with its edge, any imperfections in the edge cause the body of the fabric to be moved a corresponding amount which transmits edge imperfections into the line of travel of the fabric run. In many instances, these aberrations may be tolerated, but under other conditions, the aberrations cause defects which result in unsatisfactory processing operations. Also, in such control systems the mechanical problem of locating the cells permit unwanted movement before a correction in position is made.

Another difficulty which has been experienced is that, with the known guidance systems which are employed, corrections to the path of a fabric run introduce unwanted wrinkles and bias into the fabric. This can be tolerated in some operations but causes serious problems in others.

It is the principal object of this invention to provide a fabric aligning system and method which senses the position of longitudinally aligned threads in the fabric and maintains that thread or one closely adjacent to it in alignment, thus permitting precision control of the passage of the fabric through the processing operation. It is another object of the invention to provide an optical system which permits the observation and alignment of longitudinal threads in a moving fabric. It is an additional object of the invention to provide an improved guidance system for a moving run of fabric which is operable to move the fabric transversely of its line of movement without forming excessive wrinkles, or the like into the fabric run or introducing bias into the fabric. Other objects and advantages of the invention will become known by reference to the following description and the appended drawings in which:

Figure 8A:
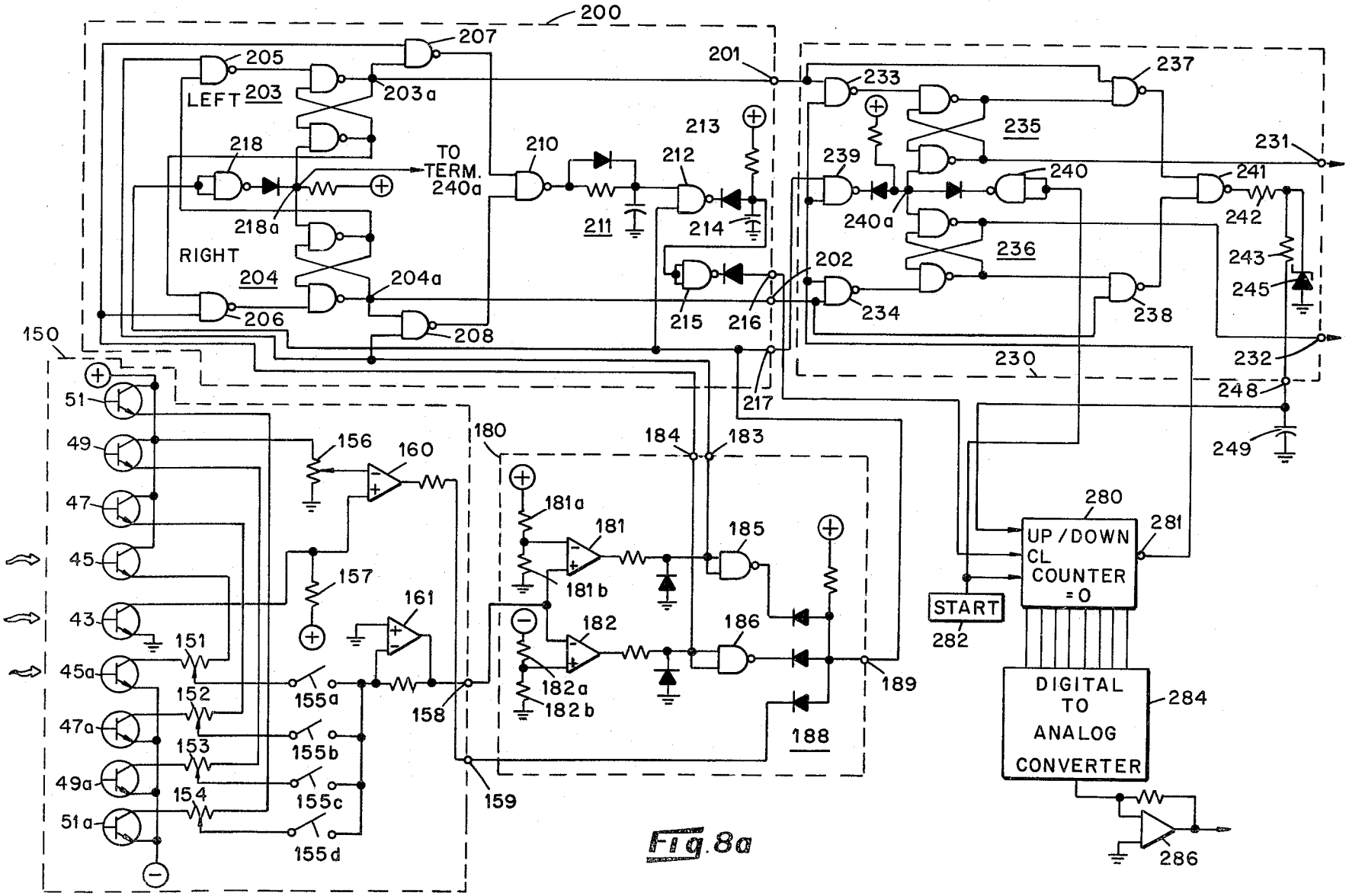
Figure 8B:
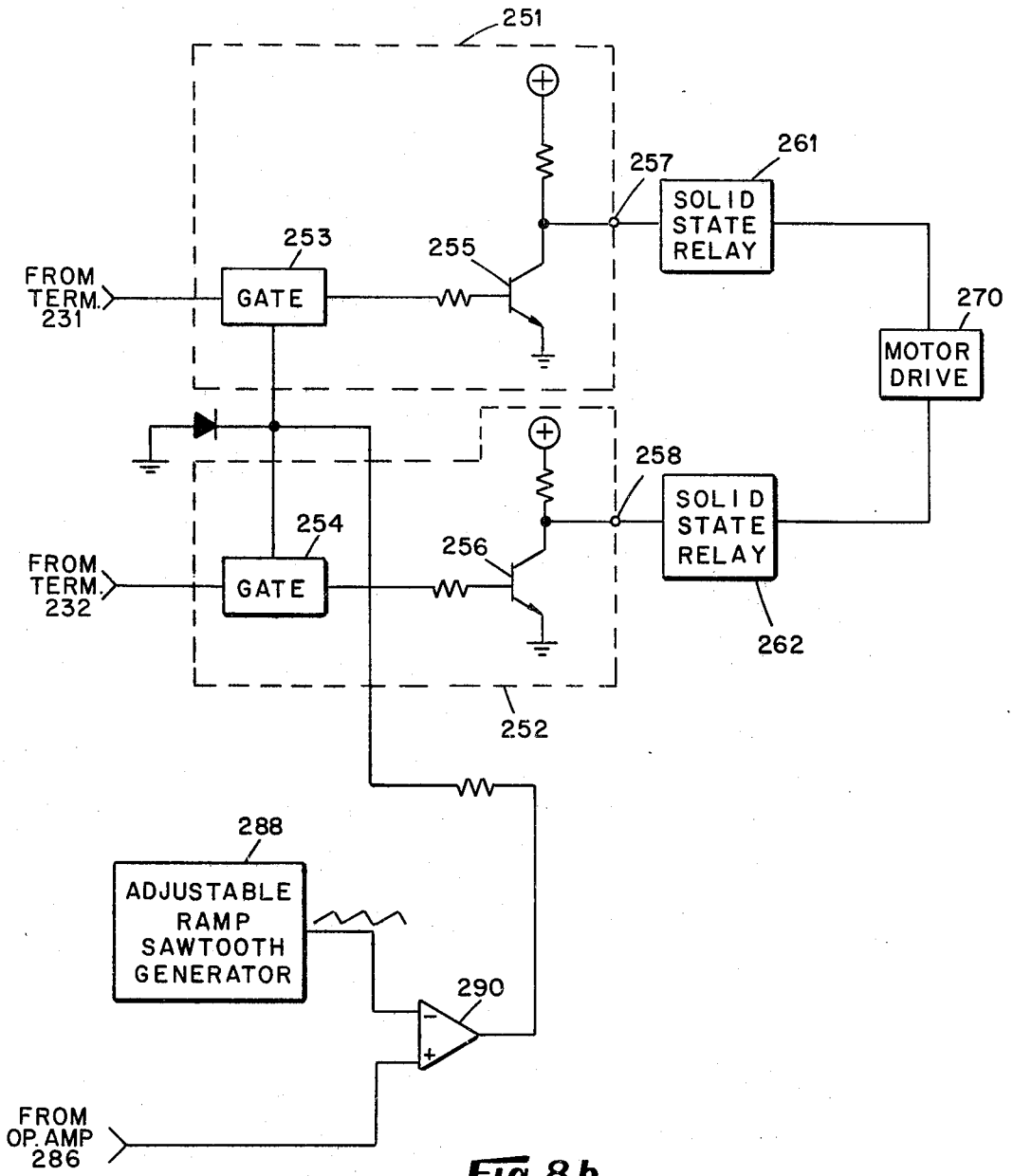

FIGS. *7a–7e* are schematic diagrams of verying imaging conditions of longitudinal threads in the optical system which are useful in explaining the operation of the invention; and FIGS. 8*a* and 8*b* illustrate logic control circuits illustrating one preferred embodiment of the invention.

Figures 4, 5:
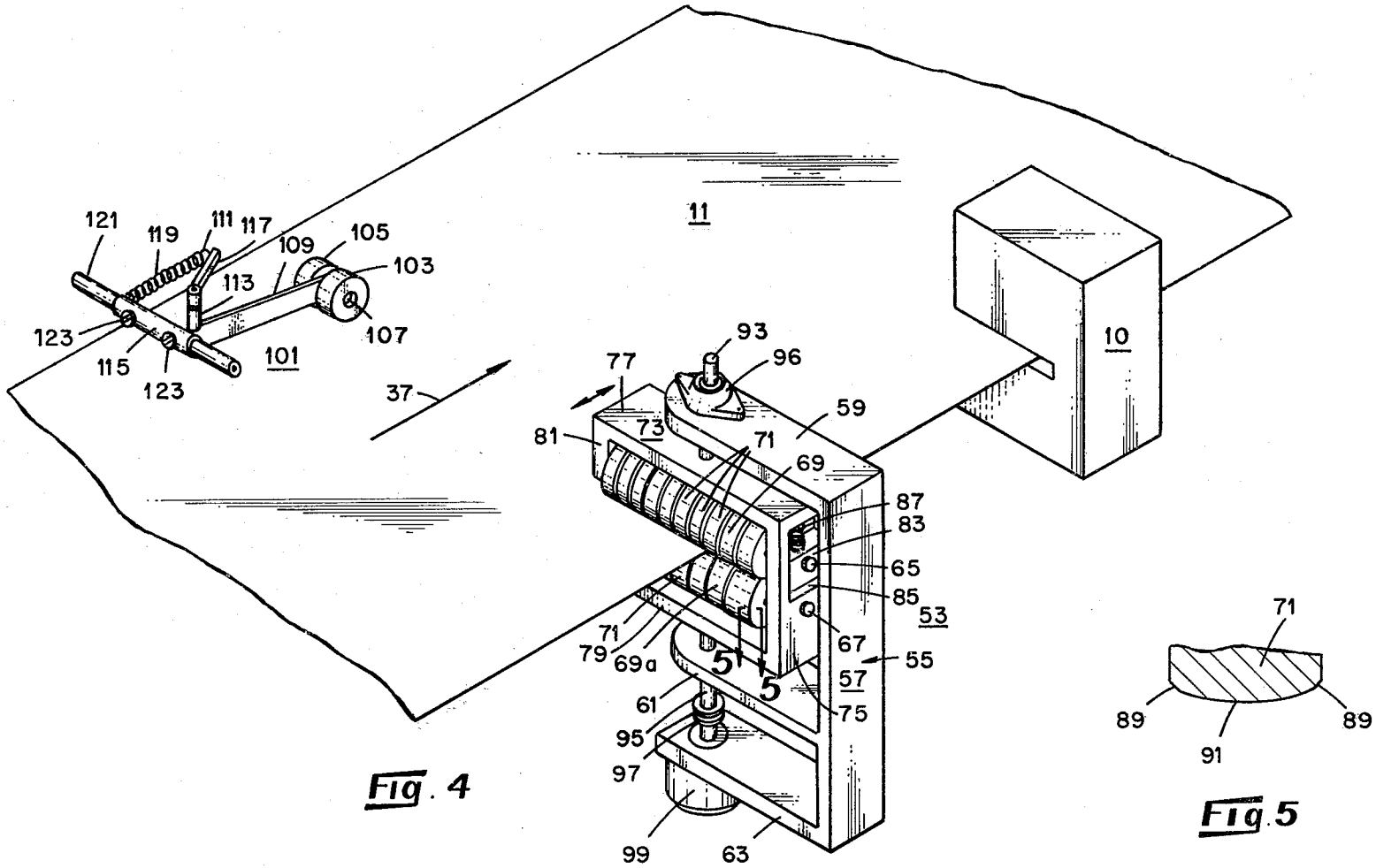
FIG. 4 is a diagrammatic, perspective view of a steering system embodying various of the features of the invention.
FIG. 5 is a sectional view taken on line 5—5 in FIG. 4.

A system embodying various of the features of the invention for aligning a moving run of fabric 11, having longitudinal threads 13 which are aligned in the direction of movement of the run and transversely aligned threads 15, is illustrated generally in FIG. 4. An optical means 10 is provided which is capable of projecting onto a target an enlarged, shadow image of longitudinally aligned threads and the spaces therebetween and of suppressing the image of any transversely aligned threads. The target includes means for sensing the position of one thread and means for determining the direction of transverse movement of threads relative to the target. Guidance means is provided to engage the run of fabric upstream of the optical means 10 to move the fabric to one side or the other so as to maintain the line of movement of the fabric in a transverse position within a few longitudinal threads of a desired position. Control means are provided for the guidance means to position it relative to the fabric so that the fabric is caused to move towards a position in which the selected thread is aligned with a predetermined fixed point. The movement of the control is effected by the sensing means and, in the illustrated embodiment, is operable to increase the degree of movement of the fabric transverse to its line of movement incident to larger errors in position.

Thus, the system is operable to maintain a thread in the fabric in alignment with a selected fixed point and, if the position of the fabric changes so as to move the thread transversely, the system will count the number of threads by which the erroneous position varies from the proper position and apply a control to the guidance means to move the fabric towards its original position until it reaches a position with the selected thread again in alignment with the selected fixed point. In the event that the system overcontrols, the process will be reversed and the selected thread will again be brought back to the fixed point. The system is operable with fine fabrics as well as relatively course fabrics and it will be seen that the transverse position of the fabric relative to its line of movement will be maintained within the limits of a few threads on either side of the selected thread during operation. This feature makes possible the alignment of the moving run of fabric relative to the threads in the fabric rather than being subject to spurious movement caused by aberrations in the marginal edges of the fabric.

Figure 1:
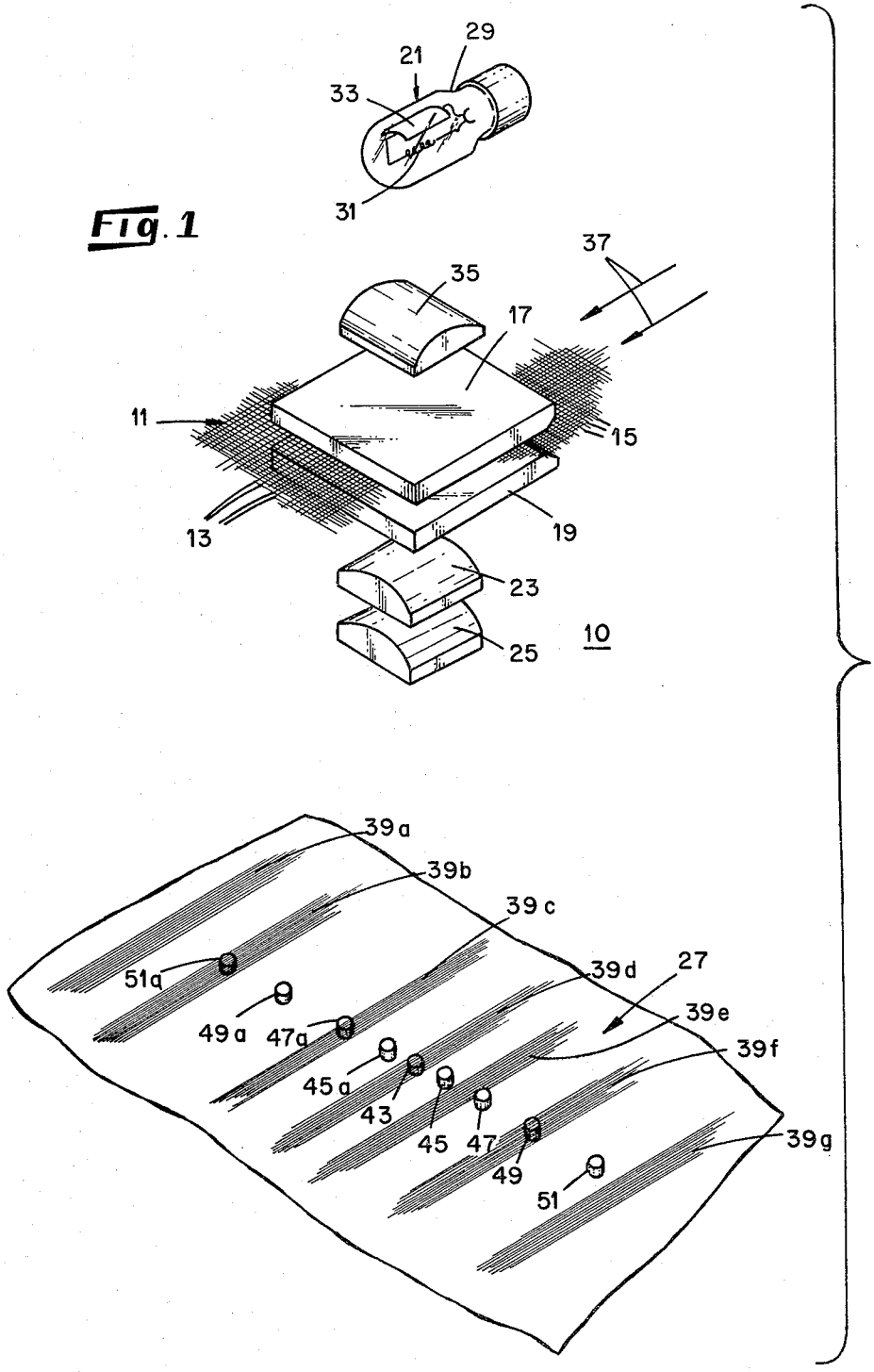
FIG. 1 is a diagrammatic, perspective view of an optical system for projecting images of longitudinally aligned fabric threads while suppressing the projection of transverse fabric threads.
Figure 2:
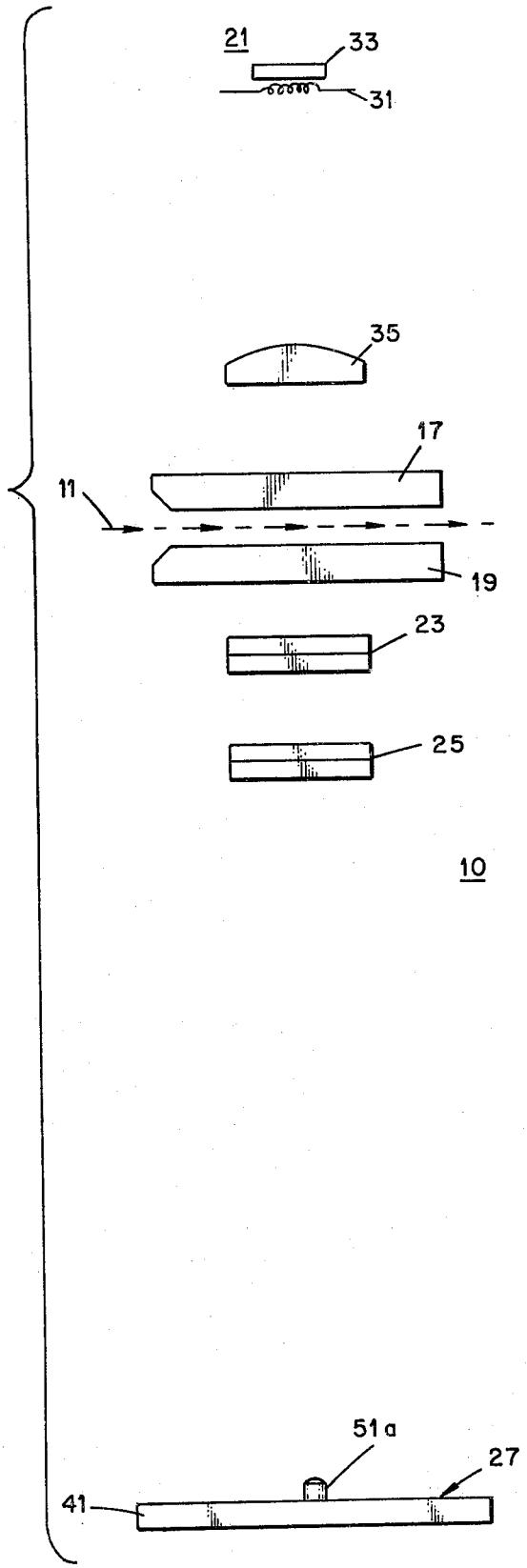
FIG. 2 is a side elevational view of the lens system shown in FIG. 1.
Figure 3:
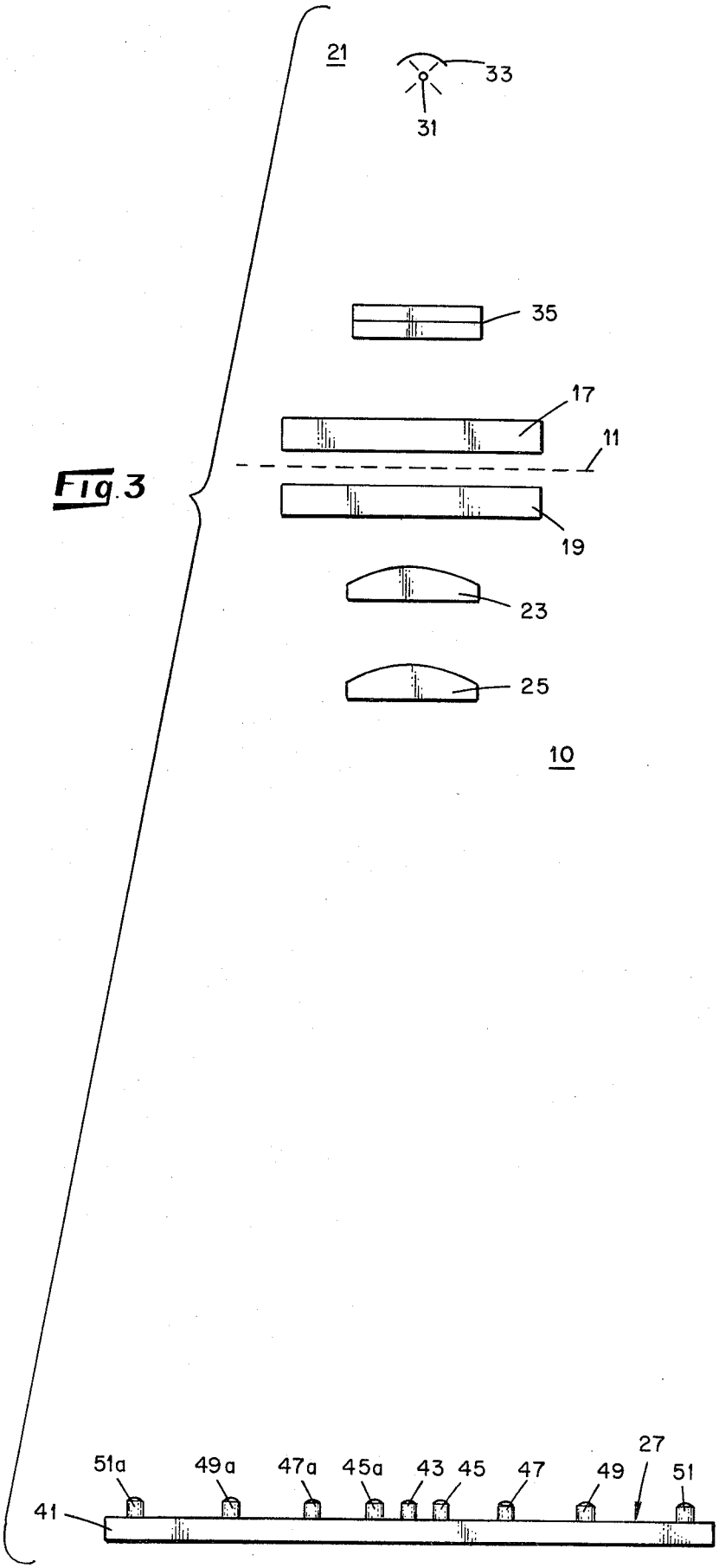
FIG. 3 is an elevational view, taken in the direction of movement of the fabric, of the optical system illustrated in FIG. 1.

Optical means 10 for projecting the image of the longitudinally aligned threads and the spaces therebetween and for suppressing the image of the transversely aligned threads is illustrated in FIGS. 1 through 3. As illustrated in FIG. 1, a fabric 11 having longitudinally aligned threads 13 and transverse threads 15 is passed between a pair of optical windows 17 and 19 which are transparent to light. A light source 21 is provided above the windows 17 and 19 and lenses 23 and 25 are provided below the windows 17 and 19 to magnify the projected image and project it onto a target 27 below the lenses 23 and 25.

The light source 21, in the specific embodiment illustrated, is an incandescent bulb 29, of the type employed in sewing machines or the like, which includes an elongated filament 31 and a reflector 33 so that the light source 21 has a substantial area rather than being a point source of light. In order to maximize the suppression of the images of the transverse threads, the elongated filament 31 should be aligned in the direction of movement of the longitudinal threads 13, as illustrated. The light from the source 21 is preferably passed through a cylindrical lens 35 having its cylindrical axis at right angles to the direction of travel of the fabric, indicated by the arrows 37. The lens 35 disperses the light from the source 21 so that the rays of light passing through the lens 35 are directed downwardly towards the windows 17 and 19 and are spread in the direction of the line of movement of the fabric 11, thus minimizing shadows of the transverse threads. Below the windows 17 and 19, the pair of cylindrical lenses 23 and 25 are provided, the cylindrical axes of which are parallel to the direction of travel of the fabric. The target 27 for shadow images 39*a*–39*g* of the threads is disposed below the lenses 23 and 25, the target 27 including a support member 41 and an array of photoelectric sensors including a central sensor 43, and flanking sensors 45, 45*a*, 47, 47*a*, 49, 49*a*, 51 and 51*a*.

In one commercial embodiment of the optical means 10, the light source 21, as previously indicated, was a standard sewing machine type bulb having a reflector, the filament 31 being aligned with the longitudinal threads to be projected. It was placed 50 mm above the lowermost surface of the cylindrical lens 35 which had 44 mm focal length and measured 24 mm×24 mm. The lens 35 was disposed 25 mm above the lowermost surface of the upper optical window 17, which window was 50 mm×50 mm×6.5 mm. The lower optical window 19 was identical in dimensions to the upper optical window 17, and its upper surface was spaced 6.5 mm from the lower surface of the upper window 17. The cylindrical lens 23 had a focal length of 44 mm and measured 24 mm×24 mm. It was located 25 mm from the upper surface of the lower window. The cylindrical lens 25 was identical to the lens 23 and was disposed with its lowermost surface 20 mm below the lowermost surfaces of the lens 23. The target 27 was disposed approximately 160 mm below the lowermost surface of the lens 25.

It will be seen that as the light source 21 and lens 35 direct light onto and through the optical windows 17 and 19 and the fabric 11, the light rays pass through the windows at various angles in the direction of movement of the fabric 11 because of the aligned filament 31 and the cylindrical lens 35 and its orientation. Thus, shadows cast by the transverse threads 15 will be suppressed. The cylindrical lenses 23 and 25 magnify the shadows cast by the longitudinally extending threads 13 and do not have a similar action on any residual shadows cast by the transverse threads 15 because of the orientation of the lenses 23 and 25 and their cylindrical surfaces. As shown in FIG. 1, the fabric 11 passing through the optical windows 17 and 19 casts shadows which comprises a series of spaced apart images 39*a*–39*g* of particular longitudinal threads, the images of the transverse threads being suppressed to the point that they are not readily observable.

As shown in FIGS. 1–3, the array of photosensitive cells 43, 45, 45*a*, 47, 47*a*, 49, 49*a*, 51 and 51*a* are disposed in alignment on the support member 41 of the target. The line of alignment of the light sensitive cell is transverse to the line of movement of the fabric 11. Each of the light sensitive cells preferably has a light receiving aperture which is smaller in dimension than the shadow cast by the smallest longitudinal thread member in a fabric which is to be used with the system. This insures that the shadow of a thread can completely cover the aperture and thus produce maximum differences in output, i.e. from a fully covered mode to a fully uncovered mode.

As will be pointed out, the central cell 43 is designed to monitor the position of the selected thread, the shadow of which is represented by 39*d* in FIG. 1. The other cells, as will be pointed out, are electrically connected in pairs, 45 being connected to 45*a*, etc., so that the flanking cells will determine differences in shadows on opposite sides of the cell 43. The flanking cells 45, 45*a*, 47, 47*a*, 49, 49*a*, 51 and 51*a* through their electrical outputs, produce a signal which is indicative of the direction of movement of transverse direction of the movement of the shadows of the longitudinal threads on the target 27.

In order to maximize the detection of movement, the cells should be positioned symmetrically. Also, the flanking cells 45, 45*a* should be located closely adjacent to the central cell 43 and the distance between cells should increase as they are positioned more remotely from the central cell 43, e.g., the distance between the cells 45 and 47 should be greater than the distance between the cells 43 and 45, etc. In the embodiment, the flanking cells were symmetrically positioned on each side of the centerline of the cell 43 the following distances: cells 45 and 45*a*—0.15 inches, cells 47 and 47*a*—0.4 inches, cells 49 and 49*a*—0.85 inches, and cells 51 and 51*a*—1.55 inches.

The guidance means 53 for the fabric is illustrated in FIG. 4. The guidance means is operable with various types of control systems. However, it is a preferable guidance means for use in connection with the system of this invention because it minimizes the production of wrinkles and folds in the fabric and does not introduce a bias into the fabric.

As illustrated, the guidance means 53 is positioned upstream from the optical means 10 relative to the line of movement 37 of the fabric 11. As illustrated, it includes an E-shaped frame 55 having a vertical upright 57 and three horizontally extending, vertically spaced arms 59, 61 and 63 which extend therefrom. Suitable means (not shown) is provided for supporting the frame 55 in a position adjacent the fabric 11.

As illustrated in FIG. 4, the guidance means 53 includes a pair of parallel, vertically spaced, horizontally disposed shafts 65 and 67, each of which carries a set of fabric engaging rolls 69 and 69*a*, respectively. Each of the sets of rolls 69 and 69*a* comprise a plurality of rolls 71, each of which rotates independently on its supporting shaft on suitable low friction bearings. The rolls 71 on each of the shafts 65 and 67 are aligned with a corresponding roll on the other of the shafts for cooperative engagement of the fabric at a nip which is of limited length and width.

The shafts 65 and 67 with their associated roll sets 69 and 69*a* are supported in a sub-frame 73. The sub-frame 73 includes a vertically disposed member 75, a pair of spaced apart horizontally disposed members 77 and 79 which are rigidly attached at opposite ends of the vertical member 75. The upper shaft 65 is journalled into bearing blocks 83 (only one of which is shown) which are slidably engaged in slots 85 in the vertical member 75 and a bracket 81 on the end of the member 77. The lower shaft 67 is journalled in a bracket (not shown) on the end of member 79 on one end and at the other end in the vertical member 75 of the subframe. Each of the bearing blocks 83 is biased downwardly by means of a spring 87 so that the fabric is held between the opposed roll sets 69 and 69*a*. The springs 87 also make it possible to readily open the roll sets 69 and 69*a* to facilitate the insertion of fabric.

The engaging surface of each of the rolls 71 in the sets 69 and 69*a* is illustrated in FIG. 5. It includes an chamfered area 89 on each peripheral edge, the chamfered areas 89 being connected by an arcuate surface 91 so as to provide a crown in the central area of the peripheral surface of the roll to minimize the transverse dimension of the nip. In one commercial embodiment, the peripheral surface of the rolls 71 was approximately one inch in width and the radius of curvature which produced the crown was about 3 inches. When the fabric is engaged between the sets of rolls 69 and 69*a* the fabric in effect is captured with a series of point contacts between the opposing rolls in each set.

The subframe 73 is adapted to be pivoted around a vertical axis so as to vary the angular relationship of the roll sets 69 and 69*a* to the line of movement of the fabric 11. To this end, the subframe 73 is provided with vertically extending shafts 93 and 95. The shaft 93 is attached to the central portion of the member 77 and is rotatably supported in a bearing 96 on the arm 59 of the frame 55. The shaft 95 is connected to the lower member 79 of the subframe 73 and is journalled for rotation in the central arm 61 of the E-shaped frame 55 and terminates in a flexible coupling 97 located between the central arm 61 and the lower arm 63 of the E-shaped frame 55. The flexible coupling 97 is connected to the shaft of a suitable motor 99 which, in the illustrated embodiment, is the control means for positioning the guidance means. Preferable motors 99 which may be employed include motors which come to speed rapidly, which are readily reversible and which do not coact excessively. Examples of such motors are alternating current, synchronous permanent magnet motors and direct current stepping motors, the former being employed with the circuitry which will be described hereinafter.

In order to maintain the fabric in a flat condition a tensioning means 101 is provided as a part of the guidance means 53. In the illustrated structure (FIG. 4), the tensioning means 101 comprises a pair of rolls 103 and 105 having cylindrical outer surfaces which are journalled for free rotation on a shaft 107 which is supported on an arm 109. The arm 109 is rigidly attached to the lower end of a vertically extending shaft 111 which is rotatably supported in a vertically extending sleeve 113. The sleeve 113 is rigidly attached to a horizontally extending sleeve 115. The upper end of the shaft 111 is rigidly connected to a crank arm 117, the outer end of which is connected by means of a spring 119 to the horizontally extending sleeve 115. The sleeve 115 is supported in position over the fabric on a rigid frame, one element of which is the horizontal extending rod 121. The position of the rollers 103, 105 transversely of the fabric is determined by the position of the sleeve 115 on the rod 121 and it is held in the desired position by set screws 123. The position of the tensioning means 101 is such that the spring 119 is always in tension so as to exert a force on the rolls 103 and 105 which urges the fabric 11 away from the roll sets 69 and 69*a*.

Assuming the fabric 11 is running true, the roll sets 69, 69*a* are arranged at right angles to the longitudinal threads 13 and the rolls 103, 105 are positioned so that as they roll they tend to draw fabric away from the roll sets 69 and 69*a* to exert a tension to maintain the fabric in a flat condition, the spring 119 maintaining the rolls 103 and 105 in position. If it is desired to steer the fabric in one direction or the other the motor 99 is actuated to rotate the axis roll sets 69, 69*a* from its right angle position to one which will move the fabric in the desired direction. Since the contact area between the cooperating individual rolls and the fabric is minimal and because the individual rolls rotate freely, the fabric is moved transversely the desired amount while minimizing the production of wrinkles or bias in the fabric, the fabric being maintained flat by the action of the spring biased rolls 103, 105.

In operation, the fabric 11 is aligned between the windows 17 and 19 and the guidance means is positioned with the sets of rollers 69 and 69*a* in engagement with the run of fabric 11 with the supporting shafts 65 and 67 for the sets of rollers being aligned transversely to the line of movement of the fabric. The tensioning means 101 is positioned on the opposite side of the run of fabric adjacent its edge with the spring 119 applying a force to the rolls 105 and 107 which maintains the fabric in a flat position under a slight tension.

The light source 21 is activated to produce images of the longitudinally aligned threads on the target 27 and the thread which is to determine position of the fabric is aligned over the photocell 43. Movement of the run of fabric is then initiated to conduct the desired operations on the fabric.

In the event that the path of travel of the fabric deviates from the desired path, the system in general operates as follows: Deviations in the position of the selected thread is monitored by upcounting the number of images of adjacent, parallel threads which pass over the original position of the selected thread on the target, i.e. the cell 43. The direction of movement of the images is determined by the output of the flanking pairs of photocells 45, 45*a*, 47, 47*a*, 49, 49*a*, 51 and 51*a* in a manner to be described subsequently in connection with the control circuits of FIGS. 6–8. The output from the cell 43 and its flanking cells is thus impressed via the control circuits, on the motor 99 to move the fabric in a direction which returns the image of the selected thread towards its original position on the target. As this occurs, the number of thread images passing over the center cell 45 is down counted until the count of zero is reached at which time the selected thread image is again in its original position. Should the fabric be caused to overshoot such that the selected image passes beyond cell 43, the count begins to increase again in the opposite direction, and the process is reversed until the selected image is returned toward its original position.

Thus, the run of fabric is maintained within a few threads of the desired position at all times.

Figure 6:
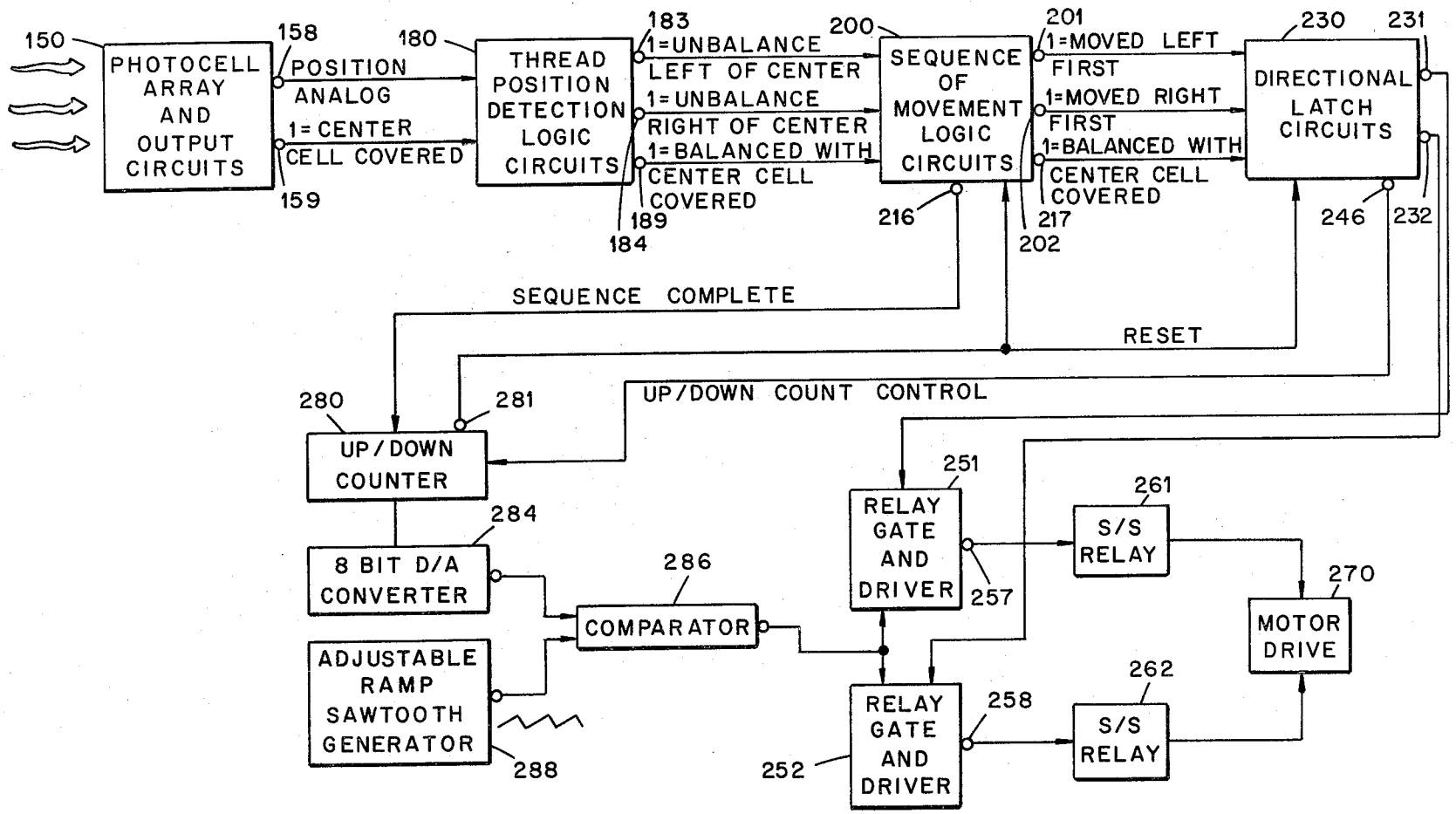
FIG. 6 is a simplified block diagram of control circuits useful in the present invention.
Figure 7A:
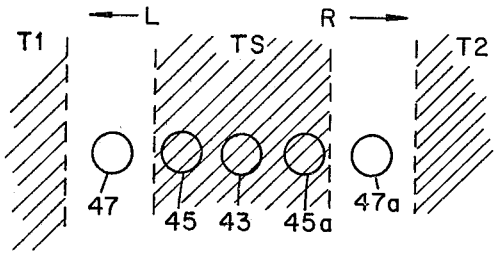
Figure 7B:
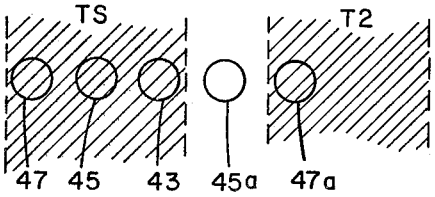
Figure 7C:
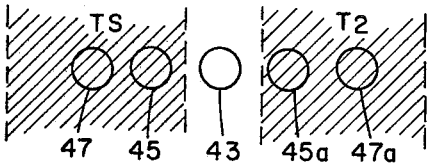
Figure 7D:
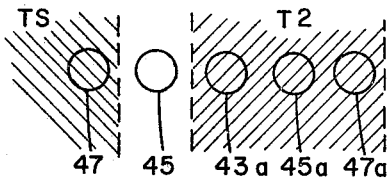
Figure 7E:
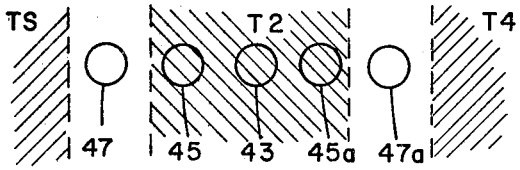

As will be seen from the ensuing discussion of the control circuits of FIGS. 6–8, in the event that the path of travel of the fabric deviates in such manner that the image of the desired thread uncovers the cell 43, no correction is initiated until the cell 43 is shadowed by an adjacent thread or threads. Thus, only if the fabric wanders sufficiently such that photocell 43 is exposed and then covered by a thread other than the selected thread, the outputs of the flanking cells will change in such a manner as to indicate the direction of required correction. This, coupled with the fact that cell 43 has counted one thread error, will cause a signal to be sent to the motor which activates it in the proper direction to position the sets of rolls 69 and 69*a* to steer the fabric in a direction which will compensate for the deviation.

As pointed out, the cell 43 is connected to a counter which determines how many images of threads have passed over the position of the cell 43 as a result of the deviation. As the count increases, the period of time that the motor 99 is energized is increased, thus increasing the degree of rotation of the subframe 73 and the amount of correction. As the selected thread returns to its original position and the count reaches zero and then begins to count threads on the other side of the thread, the direction for correction signalled by the flanking cells will be reversed and the signal is sent to the motor 99 to reverse its direction thus initiating movement of the selected thread back to its original position.

The fact that correcting action is initiated only when the cell 43 is covered is of importance to insure that a break in a thread that is being tracked does not initiate a correction. If the selected thread is broken or terminated, the unit will then home on the next thread image that it "sees", e.g. the next thread on either side of the selected thread. Also, so long as the selected thread is being tracked, aberrations in the weave over the flanking cells will not effect a correcting action.

Referring now specifically to FIG. 6, a generalized block diagram of a control circuit useful in the present invention is shown in which block 150 includes the photocell array described generally in connection with FIG. 1. Block 150 also includes the appropriate output circuits to provide, on output terminal 58, an analog position signal indicative of the balanced or unbalanced left and right orientation of the threads with respect to the photocell array as will be described in more detail subsequently. At output terminal 159, a 2-state binary output signal is provided in which a positive voltage representative of the logic "1" state indicates that the center cell is covered by a thread image while a zero voltage representative of the logic "0" state indicates that the cell is uncovered, i.e. images of adjacent threads straddle the center cell. Thread position detection logic circuits 180 operate to convert the analog signal from terminal 158 to binary position signals on terminals 183 and 184 where a logic "1" on terminal 183 indicates that the thread pattern is unbalanced to the left of the center cell while a logic "1" on terminal 184 indicates that the thread pattern is unbalanced to the right of the center cell. The logic circuits in block 180 are structured such that a logic "1" on terminal 189 represents the unique condition in which the thread pattern is balanced, i.e. symmetrically positioned with respect to the center cell of the photocell array and also the center cell 43 is covered by a thread image.

Sequence of movement logic circuits 200 operate to produce output signals which indicate whether any unbalance which has occurred resulted from the thread pattern initially moving to the left (a logic "1" on output terminal 201) or from having initially moved to the right (logic "1" on the output terminal 202). This information is significant from the standpoint of being able to generate the necessary corrective action to return the selected thread to the desired position over the center cell. These direction indicative signals are applied to directional latch circuits 230 which generate control potentials at output terminals 231 and 232 to condition the appropriate relay gate and driver circuits 251 or 252 to enable an activation signal from the output of comparator 286 to cause the motor drive 270 to move motor 99 correspondingly left or right as needed to return the selected thread to the center position on the photocell array.

As previously stated, it is desirable that the correcting action be undertaken only when the center cell 43 is covered. Thus the sequence of movement logic circuits 200 include provision for generating, at output terminal 216, a "sequence complete" signal which indicates that the selected thread has moved away from center cell 43 and has again been covered by an image of the original selected thread. This prevents false activation of the motor 99 and guidance means by the motor drive 270. This "sequence complete" signal is applied to the clock input of a conventional up-down binary counter 280 so as to cause the counter to register a count each time center cell 43 is covered by a thread image. In this connection, an up-down count control signal on output terminal 246 of the directional latch circuits 230 is applied to up-down counter 280 in known manner to condition the counter so that the count will be added or subtracted to the existing count depending on whether the direction of movement of the thread pattern is away from or back toward the original centered position in which the selected thread is positioned over the center cell. When the up-down counter registers a net zero count, indicating proper alignment of the selected thread, a reset conditioning signal is provided from output terminal 281 to the directional latch circuits 230 and to the sequence of movement logic circuits 200 to reset the circuits therein in their initial states corresponding to the centered condition of the selected thread.

The digital output of up-down counter 280 is converted by an 8 bit digital to analog converter 284 to an analog signal which is applied to one input of comparator circuit 286. The other input of comparator 286 is furnished with an adjustable ramp sawtooth signal from generator 288 to provide a proportional control of the corrective action exerted by motor drive 270 as the selected thread is being returned to its centered position over the center cell 43. If, for example, the thread pattern has moved substantially in either direction from its centered condition, the analog correction voltage applied to the comparator 286 will be greater than the peak values of the ramp sawtooth from generator 288 and thus the output of comparator 286 will cause the motor drive 270 to run continuously as it returns the thread pattern toward the centered condition. As the thread pattern approaches the original centered condition, the count in counter 280 reduces to the point at which the analog error input voltage to comparator 286 falls on the slope of the ramp voltage thus causing the motor drive to be turned on and off in effect exerting slower corrective control on the fabric guide until the error voltage reaches the zero voltage point on the ramp sawtooth generator which corresponds to a centered condition of the thread pattern. In the actually constructed embodiment of the invention, the negative points of the ramp sawtooth are arranged to be at a slightly negative potential, such as six-tengths of a volt, which in effect causes a slight over-control by motor drive 270. The result is that a slight jiggling action is exerted by the guide means on the fabric which has been found to provide improved control over positioning of the fabric.

Referring now jointly to FIGS. 7 and 8, a more detailed description of the structure and operation of the control circuits constructed in accordance with the invention will now be considered. Thus, in FIG. 8*a*, there is shown a linear array of solid state photosensitive cells in which the center cell 43 has its emitter coupled to ground and its collector coupled to one input of comparator circuit 160. The other input of comparator 160 is furnished with an adjustable source of positive voltage from the movable arm of potentiometer 156.

Flanking center cell 43 are two banks of symmetrically disposed cells in which cells 45, 47, 49 and 51 underlie the threads to the left of center cell 43 (in relation to the direction of fabric travel) while cells 45*a*, 47*a*, 49*a* and 51*a* underlie the threads to the right of the center cell 43. The cells in the left bank have their collectors coupled in common to a source of positive potential while the cells in the right bank have their emitters coupled to common to a source of negative potential. Cells in corresponding positions from each bank are individually paired in conductive relationship through potentiometers 151–154. The movable arms of potentiometers 151–154 are individually connected through set-up switches 155*a*–155*d* to a common input terminal of summing amplifier 161. The individual left and right photocells act as switches conditioned to be opened or closed by the incidence of light on their respective photosensitive bases to place the resistances of their respective potentiometers into the summing circuit of summing amplifier 161. Thus the voltage output on terminal 158 is dependent on the conductive condition of one or more of the photosensitive cells. Set-up switches 155*a*–155*d* are normally closed during operation of the control circuit and are used individually during the set-up procedure to balance the potentiometer settings such that when all photocells are fully exposed to light, a net zero voltage appears at upper terminal 158. The values of each of the potentiometer resistances are set such that the photocells 45 and 45*a* have the greatest effect on the output voltage at terminal 158 while cells further away have a lesser effect with the more distant photocells 51 and 51*a* having the least effect. In an actually constructed embodiment, potentiometer 151 was 25K ohm, potentiometer 152 was 50K ohm, potentiometer 153 was 100K ohm and potentiometer 154 was 250K ohm. The photocells used were Motorola type 3056.

Before considering the remainder of the control logic circuits, it will be helpful to refer to the illustrations of FIGS. *7a*–*7e* to describe the manner in which the output control signals are generated at terminals 158 and 159. Thus with reference to FIG. *7a*, a condition is illustrated in which the selected thread TS is shown as having its image centered over center photocell 43 and being symmetrically balanced with respect to the side banks of photocells. For simplicity of description, only two photocells from each of the side banks are illustrated. Also, for simplification, the thread image is shown to be of sufficient width to cover the central cell 43 and the two innermost flanking cells 45 and 45*a*, this is not a necessary condition but it simplifies a description of the operation. In the condition, shown in FIG. *7a*, which corresponds to an aligned position the center photocell 43 is non-conductive since no light impinges on the photosensitive base of the cell. This causes amplifier 160 to produce a positive potential at output terminal 159. Since the thread pattern is symmetrically disposed with respect to the side banks of photocells, the summation of currents through potentiometers 151 and 154 is zero and thus the voltage at output terminal 158 is zero.

Referring now to FIG. *7b*, the thread pattern is shown as having shifted slightly to the left with the center cell 43 still being covering by the image of the selected thread TS and thus the output terminal 159 remains positive. However, the thread pattern is now unbalanced or shifted such that, although the left hand cell 45 remains covered, the right hand cell 45*a* has become uncovered. This exposure to light causes a positive current flow through summing amplifier 161 resulting in a positive output voltage on output terminal 158. Assuming the thread pattern continues to shift to the left as shown in FIG. *7c*, the center photocell 43 is now uncovered and conducts to cause a zero voltage to appear at outlet terminal 159. However, the thread pattern is now balanced with respect to the side banks of photocells resulting in a zero voltage on output terminal 158. As the thread pattern continues to move to the left as seen in FIG. *7d*, the condition now corresponds to that of an unbalance to the right with the center cell 43 being covered. It should be kept in mind that the center cell responds only to coverage or non-coverage and is not able to indicate which thread is causing the coverage or to indicate in which lateral direction the fabric was moving when the coverage or uncoverage occurred. Therefore, electrically, the effect on the voltage at output terminal 158 is the same whether the fabric initially moved left or right. Thus in FIG. *7d*, the left photocell 45 is conductive and the right photocell 45*a* is non-conductive causing a negative current flow to flow through summing amplifier 161 to produce a negative voltage at the output terminal 158. Finally, in FIG. *7e*, a balanced condition is illustrated with cell 43 covered which, electrically, is identical to the condition illustrated in FIG. *7a* except that it is caused as a result of the fabric having shifted laterally by one thread.

The analog output signal on terminal 158 is applied to the non-inverting input of comparator 181 and the inverting input of comparator 182. The inverting input of comparator 181 is connected to a source of reference potential appearing at the intermediate terminal of voltage divider 181*a* and 181*b*. The resistance value of 181*a* in the actually constructed embodiments was 47K ohm while that of 181*b* was 2.7K ohm so as to result in a slightly positive potential on the inverting side of comparator 181. Similarly, the non-inverting side of comparator 182 is coupled to the intermediate point of voltage divider 182*a*, 182*b* with 182*a* being 47K ohm and 182*b* being 2.7K ohm so as to provide a slightly negative potential to comparator 182. In this way, when an unbalance left condition is sensed by the photocells, the positive voltage on terminal 158 generates a corresponding positive potential at output terminal 183 with output terminal 184 remaining at zero volts. Similarly, an unbalance right condition sensed by the photocells will cause a negative voltage at output terminal 158 which will cause the output of comparator 182 at terminal 184 to go positive while the output of comparator 181 at output terminal 183 will be zero. Hereinafter the voltage levels of the circuits will be referred to in terms of their logic states of "1" corresponding to a positive voltage and "0" corresponding to a ground potential. Thus it will be seen that when the thread pattern is balanced over the photocell array terminals 183 and 184 will both be "0". A "1" on either terminal 183 or 184 will indicate respectively an unbalance left or unbalance right condition. The output of center photocell 43 is connected through output terminal 159 to one arm of AND circuit 186. The thread position logic signals from comparators 181 and 182 are also coupled through NAND circuits 185 and 188, acting as inverters, to the remaining two legs of AND circuit 188 so as to produce on output terminal 189 a "1" logic signal which is uniquely representative of the fact that the thread pattern is symmetrically positioned over the photocell array with center photocell 43 covered.

Since the signals at output terminals 183 and 184 and 189 provide information only with respect to position, a static condition, they are ambiguous as to the dynamic conditions respecting direction and magnitude of lateral movement of the thread pattern on fabric. Thus there is provided a "sequence of movement" logic circuit 200 comprising means for determining the direction of movement of the selected longitudinally aligned thread as it moves transversly of the center cell 43. This includes left and right latch circuits 203 and 204 which, in their initial reset condition, have their respective output terminals **203*a* and 204*a* at logic "0". The unbalance left position signal is fed from output terminal 183 through NAND gate 205 to the set side of left latch circuit 203. This unbalance left signal is also applied to an input of NAND gate 208, the other input of which is coupled to the set output terminal 204*a* of right latch circuit 204. Similarly, the right unbalance signal from output terminal 184 is fed to the set side of right latch circuit 204 via NAND gate 206 and is also coupled to an input of NAND gate 207, the other input of which is coupled to the set output terminal of left latch 203. The set output terminals 203*a* and 204*a* are connected to output terminals 201 and 202 respectively to provide an indication of the initial direction in which the thread pattern moved when the selected thread moved off from the center cell 43**.

The outputs of NAND gates 207 and 208 are coupled to the input of NAND gate 210 and from there through a time constant circuit 211 to one input of NAND gate 212. The other input of NAND gate 212 is fed from output terminal 189 which it will be recalled provides a signal which is representative of the balanced condition of the thread pattern with the center photocell 43 covered. This latter signal is also coupled to NAND gate 218 to serve as a latch resetting signal for left and right latch circuits 203 and 204. The output of NAND gate 212 is coupled via a RC circuit 213, 214 to NAND gate 215, acting as an inverter circuit, to output terminal 216. The signal appearing at output terminal 216 is coupled to the clock input of up-down counter 280 to cause a count to be registered each time a logic "1" appears at output terminal 216. The circuit just described comprises, therefore, means responsive to transverse movement of the fabric relative to center cell 43 to count the number of longitudinally aligned threads passing over cell 43 and thereby provide an indication of the magnitude of lateral movement of the fabric.

In order to activate the motor drive 270 to cause the guidance means to return the wandering fabric to its initial centered position with the selected thread centered over the center cell 43, means including directional latch circuits 230 are provided to sense the initial direction in which the selected thread has moved away from center cell 43 to condition the appropriate right or left driving relay 261 or 262 to cause the motor drive 270 to operate the guidance means so as to return the fabric to its centered position. To this end, left and right latching circuits 235, 236 are respectively fed via NAND gates 233 and 234 from output terminals 201 and 202 of "sequence of movement" circuit 200. It should be noted that latch circuits 235 and 236 are initially reset only by a start circuit 282 coupled through NAND gate 240 (which is initiated at the beginning of the fabric run) or by the coincidence of a "1" signal (fabric centered) on output terminal 189 with the zero count output terminal 281 of counter 280 fed through NAND gate 239 to reset terminal **240*a*. Since the zero count signal from counter output terminal 281 is coupled to the inputs of NAND gates 233 and 234 to which the direction of movement signals from circuit 200 are applied, the latch circuits 235 and 236 can be set to indicate left or right movement only at the beginning of a fabric run or when the selected thread first moves off from center cell 43. Until the system operates to bring the thread pattern back into a centered or balanced condition, the latches will remain set in their initially set condition thus assuring that the motor drive 270 operates the motor 99** only in one direction.

It will also be recalled that the signal on output terminal 216 of "sequence of movement" circuit 200 causes up-down counter 280 to register a count each time a "1" appears on terminal 216. It is necessary however to condition the counter to accept this count as an addition or subtraction count depending on whether the fabric is being moved away from or back to its centered condition with the selected thread centered over the center cell 43. To this end, the set sides of latch circuits 235 and 236 are coupled to one input side respectively of NAND GATES 237 and 238, the other input sides of which are fed with the left and right signals from output terminals 201 and 202. The outputs of NAND gates 237 and 238 are coupled to the input sides of NAND gates 241 which in turn is fed through a time constant circuit including resistor 243 and capacitor 249 to the up-down conditioning terminal of up-down counter 280. Zener diode 245 is coupled from the intermediate connection of resistors 242 and 243 to limit the voltage applied to the up-down terminal as may be required by the particular counter employed. The coincidence of logic "1" inputs to either of NAND gates 237 or 238 which would indicate that the fabric is continuing to move away from its centered condition causes the output of NAND gate 241 to go high to a voltage level determined by zener diode 245 which conditions up-down counter 280 to accept the signal from output terminal 216 as an additional count thus causing counter 280 to continue its up count. The time constant circuit 243, 249 holds this conditioning signal long enough to assure proper registration of the count from output terminal 216.

Referring again to sequence to movement logic circuit 200, a more detailed description of its operation will now be considered. Assuming the thread pattern is initially centered with the selected thread covering the center cell 43, a logic "1" will appear at output terminal 189 and a logic "0" will appear at each of terminals 183 and 184. Latch circuits 203 and 204 will have been reset either by operation of start circuit 282 or by the logic "1" through NAND gate 218. When the thread pattern begins to shift left (FIG. 7*b*) a logic "1" will appear at output terminal 183 which will coincide at NAND gate 205 with the logic "1" from the reset side of latch circuit 204 to cause latch circuit 203 to set and furnish a logic "1" at output terminal 201 indicating that the fabric is beginning to move left. The logic "1" at terminal 203*a* is also applied to the input of NAND gate 207; however, the other input remains at a logic "0" and thus nothing occurs at the output of NAND gate 207. The logic "1" at output terminal 201 sets the directional latch 235 thus conditioning transmission gate 253 to a transmitting condition however at this point the up-down counter is a zero count providing a zero output at comparator 290 and thus motor 270 is not activated.

As the thread pattern continues to move to the left (FIG. 7*c*), the center cell is uncovered and the thread pattern is balanced over the side banks of the photocells. Although this causes the output at terminal 189 to go to a logic "0", no change in logic states occurs in any of the control circuits. Now as the thread pattern continues to move further left (FIG. 7*d*), an unbalanced right condition occurs with cell 43 covered. This causes the output terminal 184 to go to a logic "1" which coincides at the input of NAND gate 207 with the logic "1" from terminal 203*a* to cause the output of 207 to go to a zero. This in turn causes the output of NAND gate 210 to go to a "1" which charges the capacitor of the time constant circuit 211 through the diode to a positive condition. Although center cell 43 is now covered causing a logic "1" output terminal 159 to be applied to AND gate 188, the output terminal 189 remains zero since the unbalanced condition causes a zero input to be applied from NAND gate 186 to the second leg of AND gate 188.

Finally, when the thread pattern has completed its sequence of movement such that it is balanced over the photocell array with center cell 43 covered this time by the adjacent thread T2, a logic "1" is generated at output terminal 189 which is fed through NAND gate 212 and output terminal 216 to cause an up count to be registered at counter 280. The balancing of the thread pattern over the photocell array also causes the output terminal 184 to revert from a logic "1" to a logic "0" which when applied to the input of NAND gate 207 causes the output of NAND gate 210 to drop to a logic "0". In order to assure the coincidence of a logic "1" from output terminal 189 with the logic "1" previously applied from NAND gate 210 to the inputs of NAND gate 212, the time constant circuit 211 is included to hold the positive potential (logic "1") at the input of 212 sufficiently long to assure that the logic "1" from output terminal 189 is gated through to cause a count to be registered in the up-down counter 280.

It will be apparent from this description that if the movement of the thread pattern were such as to cause the selected thread to wander off from the center cell 43 and then wander back on before an adjacent thread is able to cover the center cell, no count will be recorded in counter 280. Thus, in order for a count to be registered, the thread pattern must move through a predetermined minimum amount of transverse movement corresponding a complete sequence in the prescribed order, i.e. unbalance one direction, unbalance another direction followed by covering of the center cell. This assures that the motor 99 and guidance means will be activated only in response to a true condition of a lateral shift of the thread pattern.

While, in accordance with the patent statutes, there has been described what at present is considered to be the preferred embodiment of the invention, it will be apparent to those skilled in the art that various changes and modifications may be made therein without departing from the invention. It is intended, therefore, by the appended claims to cover all such changes and modifications as fall within the true spirit and scope of the invention.

What is claimed:

1. A system for aligning a moving run of fabric having longitudinal threads which are aligned in the direction of movement of the run and transversely aligned threads including:

(a) optical means for projecting an image of threads from said fabric onto a fixed target, said optical means enlarging the image of longitudinally aligned threads and the spaces therebetween and suppressing the image of transversely aligned threads, (b) means for sensing the original position of a selected, longitudinally aligned thread relative to a fixed point on said target, (c) counting means connected to said sensing means, said counting means being responsive to transverse movement of the fabric relative to said fixed point to count the number of longitudinally aligned threads passing across said fixed point on said target, (d) means for determining the direction of movement of said selected, longitudinally aligned thread transversely of said fixed point, (e) guidance means engaging said fabric for moving said fabric transversely across said fixed point, (f) control means for said guidance means, said control means being adapted to position said guidance means to effect a change in the transverse position of said fabric relative to said fixed point on said target, (g) means responsive to said counting means and said direction determining means for activating said control means in response to transverse movement of said selected, longitudinally, aligned thread relative to said fixed point on said target to steer said fabric towards a position in which said selected, longitudinally aligned thread is in its original position relative to said fixed point.

2. The system of claim 1 in which the sensing means and direction determining means includes a linear array of photosensitive cells comprised of a centrally disposed cell corresponding to said fixed target point and at least one pair of cells flanked on either side of the central cell, the central cell providing an output signal representative of said original thread position and the flanking cells providing a signal for determining the direction of movement of said fabric.

3. The system of claim 2 in which said pair of cells is coupled to means for generating an output signal representative of unbalanced alignment of said selected thread to either side of said central cell.

4. The system of claim 1 in which the counting means includes means for suppressing said thread count until a predetermined minimum transverse movement of the fabric has occurred.

5. The system of claim 3 in which the counting means includes means for suppressing said thread count until a predetermined sequence of unbalanced thread alignment is sensed representative of complete transverse movement of said fabric from alignment of one longitudinal thread with said fixed target point to alignment of the next adjacent longitudinal thread with the fixed target point.

6. The system of claim 1 in which the direction determining means includes means for sensing a reversal of said movement direction after said fabric has initiated transverse movement in a first direction.

7. The system of claim 6 in which means are included responsive to said direction determining means for conditioning the counting means for increasing its count in response to movement of the selected thread away from alignment with the fixed target point and for reducing its count in response to movement of the selected thread toward the fixed target point.

8. The method of aligning movement of a run of fabric having longitudinal and transverse threads with a selected longitudinally aligned thread comprising the steps of projecting an image of the longitudinally aligned threads on a target and suppressing the image of transverse threads, determining the original position of the image of the selected thread on the target, monitoring deviations in the position of the selected thread, determining the direction of movement of the images, and moving the fabric in a direction to return the image of the selected thread towards its original position on the target.

9. The method of claim 8 in which the deviations in the position of the selected thread are monitored by counting the number of images of threads which move over the original position of the selected thread on the target.

* * * * *